US009526382B2

(12) United States Patent
Granger

(10) Patent No.: US 9,526,382 B2
(45) Date of Patent: Dec. 27, 2016

(54) APPARATUS FOR DISPENSING PRECUT MATERIALS WOUND INTO A COIL OR FOLDED INTO A "Z"

(71) Applicant: Maurice Granger, Albufeira (PT)

(72) Inventor: Maurice Granger, Albufeira (PT)

( * ) Notice: Subject to any disclaimer, the term of this patent is extended or adjusted under 35 U.S.C. 154(b) by 0 days.

(21) Appl. No.: 14/428,886

(22) PCT Filed: Aug. 9, 2013

(86) PCT No.: PCT/FR2013/051915

§ 371 (c)(1),
(2) Date: Mar. 17, 2015

(87) PCT Pub. No.: WO2014/041267

PCT Pub. Date: Mar. 20, 2014

(65) Prior Publication Data

US 2015/0245745 A1 Sep. 3, 2015

(30) Foreign Application Priority Data

Sep. 17, 2012 (FR) ..... 12 58692

(51) Int. Cl.
*A47K 10/42* (2006.01)
*A47K 10/34* (2006.01)
*A47K 10/32* (2006.01)

(52) U.S. Cl.
CPC ..... *A47K 10/34* (2013.01); *A47K 10/42* (2013.01); *A47K 2010/3233* (2013.01)

(58) Field of Classification Search
CPC ..... A47K 10/36
See application file for complete search history.

(56) References Cited

U.S. PATENT DOCUMENTS 2,273,384 A 2/1942 Steiner et al.
2,590,718 A 3/1952 Lundquist
(Continued)

FOREIGN PATENT DOCUMENTS

EP 0 034 121 B1 8/1981
EP 0 387 160 B1 9/1990
(Continued)

*Primary Examiner* — Gene Crawford
*Assistant Examiner* — Ayodeji Ojofeitimi
(74) *Attorney, Agent, or Firm* — Seed IP Law Group LLP

(57) ABSTRACT

An apparatus for dispensing pre-cut material wound into a coil or folded into a "Z" comprises a casing forming a receptacle with a bottom plate, a lower horizontal wall, vertical walls with a lid that is hinged at the base of the casing and raised vertically up to its closure. The apparatus also comprises a shutter attached to the side walls of the casing and is positioned vertically. The said shutter has in its upper portion a curvilinear configuration for the passage and guidance of the pre-cut strip of material. The said strip of material passes between the said shutter and said lid. The said shutter and said lid each has an identical central cut to allow the release of the pre-cut strip of material and its gripping. The said shutter has around the peripheral edge of said cut, an element having a curvilinear configuration over the entire circumference of the peripheral edge of the said central cut formed on the shutter perpendicular to the shutter plane, and in that the said element has a progressive height differentiated from its central part corresponding to the upper part of the central cut up to its ends forming a ramp. The said ends of said element provide penetration into the strip of material in the pre-cut line thereof to then ensure full transverse tearing and separation of a given section of material.

9 Claims, 7 Drawing Sheets

(56) References Cited

U.S. PATENT DOCUMENTS

| | | | | |
|---|---|---|---|---|
| 2,683,641 | A | 7/1954 | Larson | |
| 2,832,549 | A | 7/1954 | Youngberg | |
| 2,695,208 | A | 11/1954 | Graham | |
| 4,165,138 | A | 8/1979 | Hedge et al. | |
| 4,389,026 | A | 6/1983 | Willa et al. | |
| 4,467,974 | A | 8/1984 | Crim | |
| 4,611,768 | A | 9/1986 | Voss et al. | |
| 5,207,633 | A | 5/1993 | Granger | |
| 5,335,811 | A | 8/1994 | Morand | |
| 5,897,074 | A | 4/1999 | Marino | |
| 6,202,956 | B1 | 3/2001 | Grasso et al. | |
| 6,736,348 | B1 | 5/2004 | Formon et al. | |
| 7,040,567 | B1 | 5/2006 | Lewis et al. | |
| 7,093,737 | B2 | 8/2006 | Tramontina et al. | |
| 8,191,736 | B2 | 6/2012 | Beranger | |
| 8,672,255 | B2 | 3/2014 | Granger | |
| 1,135,658 | A1 | 4/2015 | Brown et al. | |
| 2010/0001015 | A1* | 1/2010 | Thoren ..... | A47K 10/3818 221/30 |
| 2011/0089213 | A1 | 4/2011 | Granger | |
| 2011/0101020 | A1 | 5/2011 | Granger | |
| 2011/0174833 | A1 | 7/2011 | Granger | |
| 2011/0284861 | A1 | 11/2011 | Kim et al. | |
| 2013/0256450 | A1 | 10/2013 | Granger | |
| 2013/0277492 | A1 | 10/2013 | Granger | |
| 2013/0320132 | A1 | 12/2013 | Granger | |
| 2013/0334272 | A1 | 12/2013 | Granger | |

FOREIGN PATENT DOCUMENTS

| | | | |
|---|---|---|---|
| FR | 957 096 | | 10/1947 |
| FR | 1 060 322 | | 4/1952 |
| FR | 1 058 449 | | 3/1954 |
| FR | 1 058 471 | | 3/1954 |
| FR | 1 059 244 | | 3/1954 |
| FR | 2 931 350 | A1 | 11/2009 |
| FR | 2 960 760 | A1 | 12/2011 |
| FR | 2 966 034 | A1 | 4/2012 |
| FR | 2 968 530 | A1 | 6/2012 |
| FR | 2 970 167 | A1 | 7/2012 |
| FR | 2 983 694 | A1 | 6/2013 |
| WO | 2009/150342 | A2 | 12/2009 |
| WO | 2009/150351 | A1 | 12/2009 |
| WO | 2010/007261 | A1 | 1/2010 |
| WO | 2010/034915 | A1 | 4/2010 |
| WO | 2010/063917 | A1 | 6/2010 |
| WO | 2010/089467 | A1 | 8/2010 |

* cited by examiner

Fig. 1
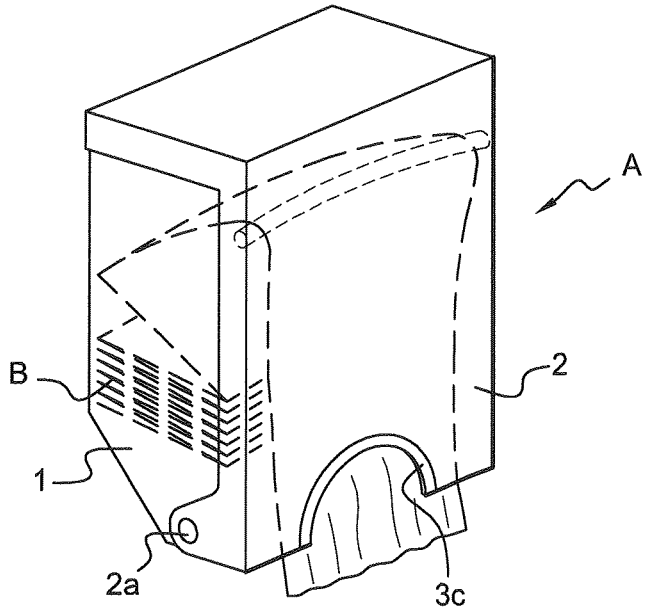
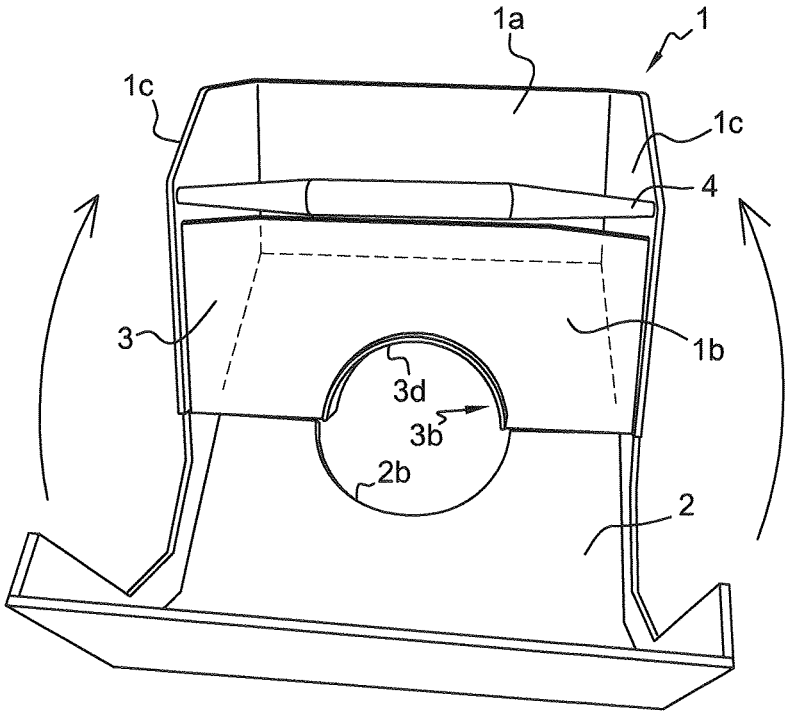
Fig. 2

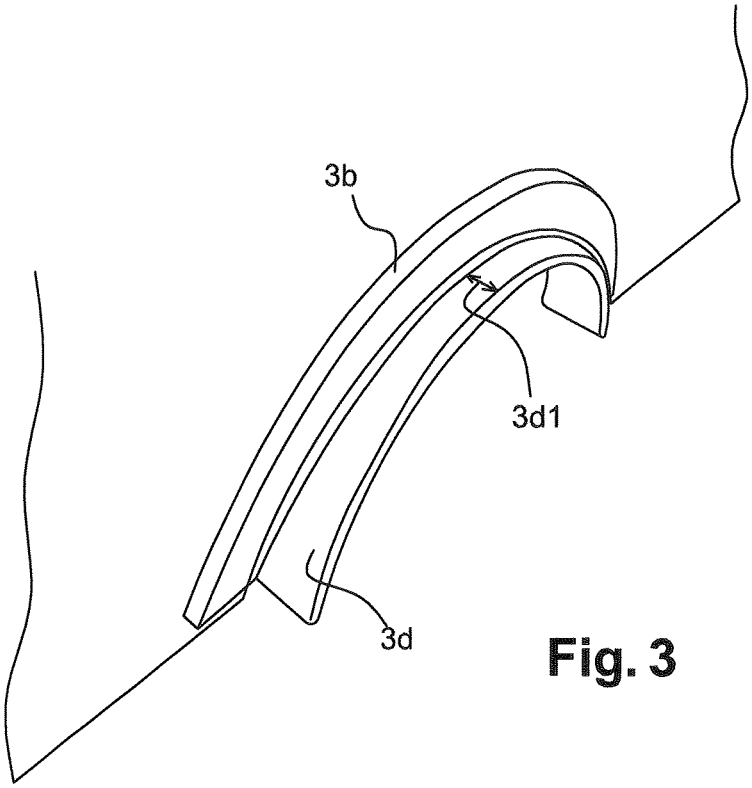
Fig. 3
Fig. 4
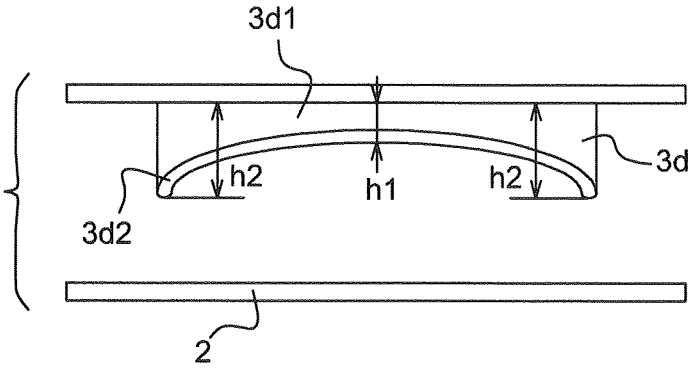
Fig. 5
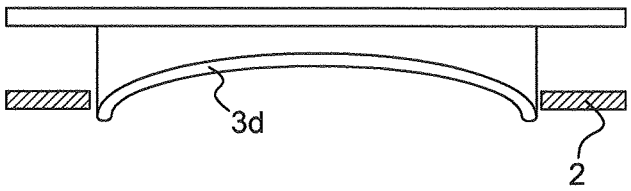

Fig. 6
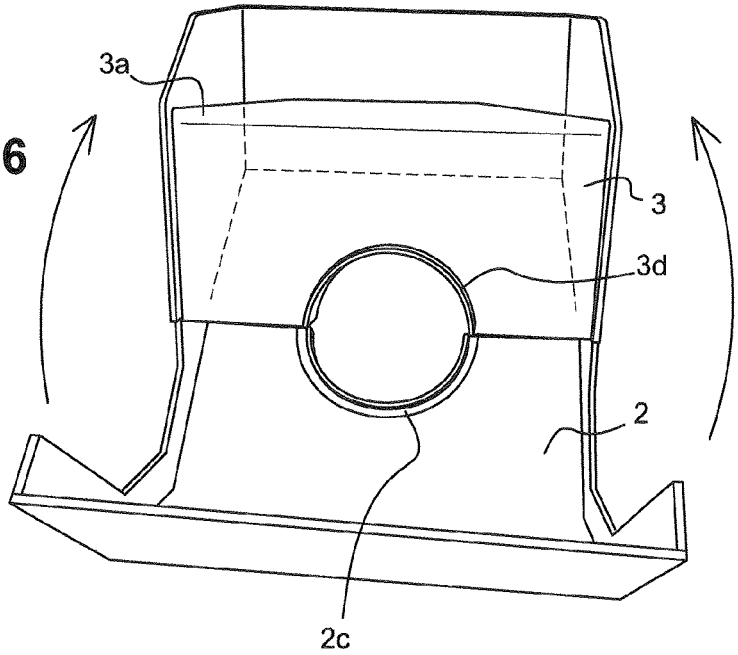
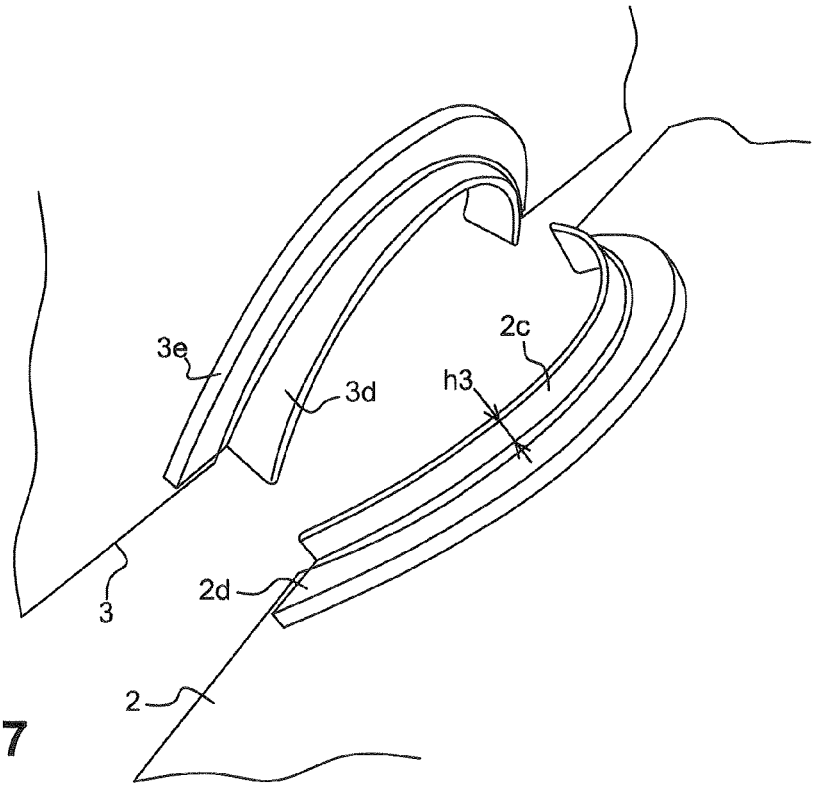
Fig. 7

Fig. 12
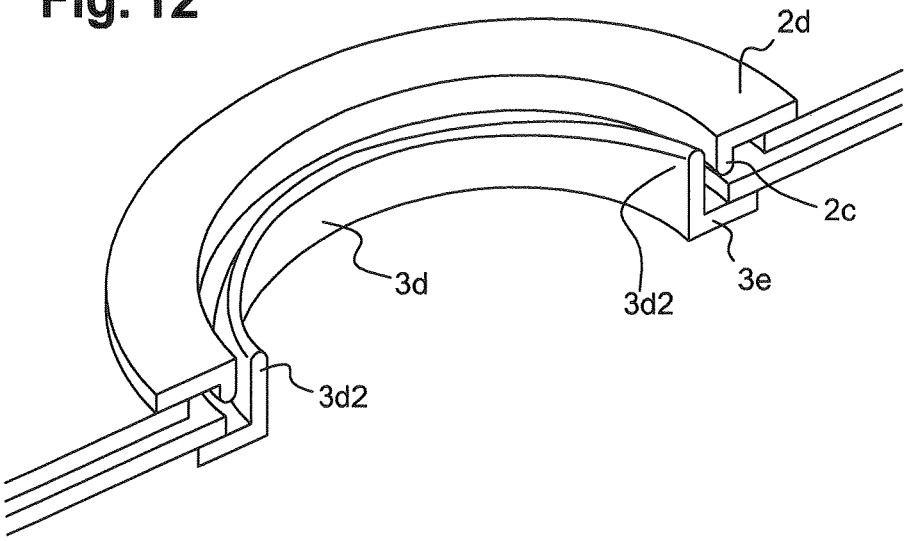
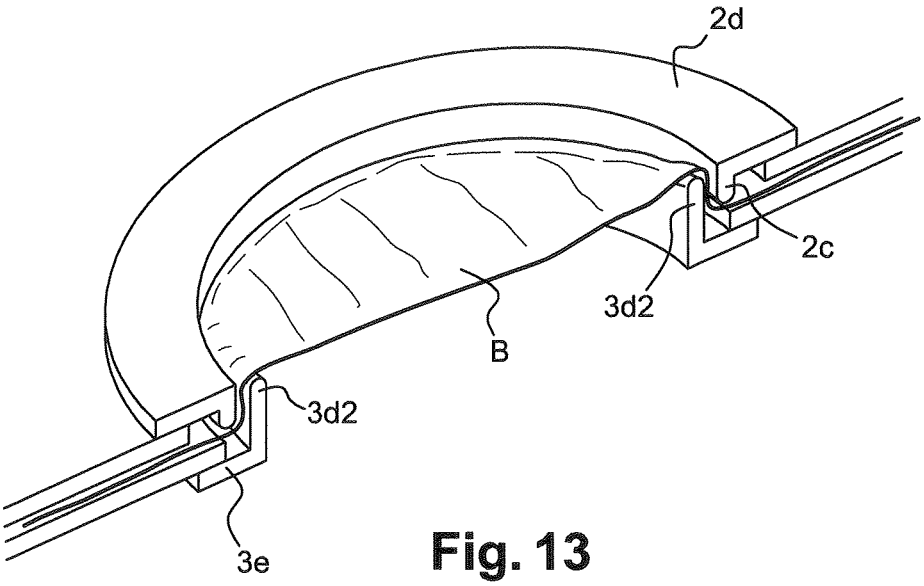
Fig. 13

Fig. 14
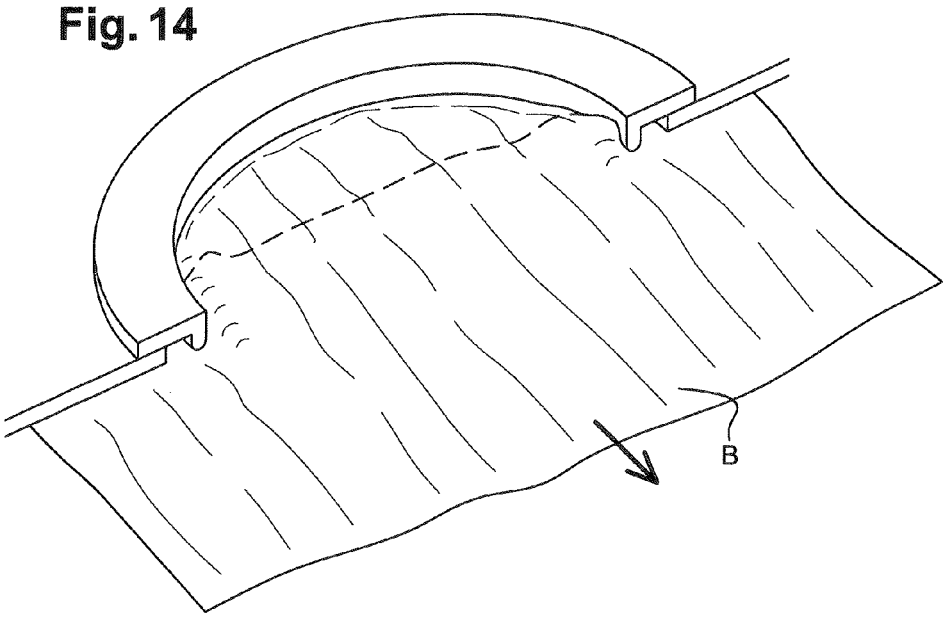
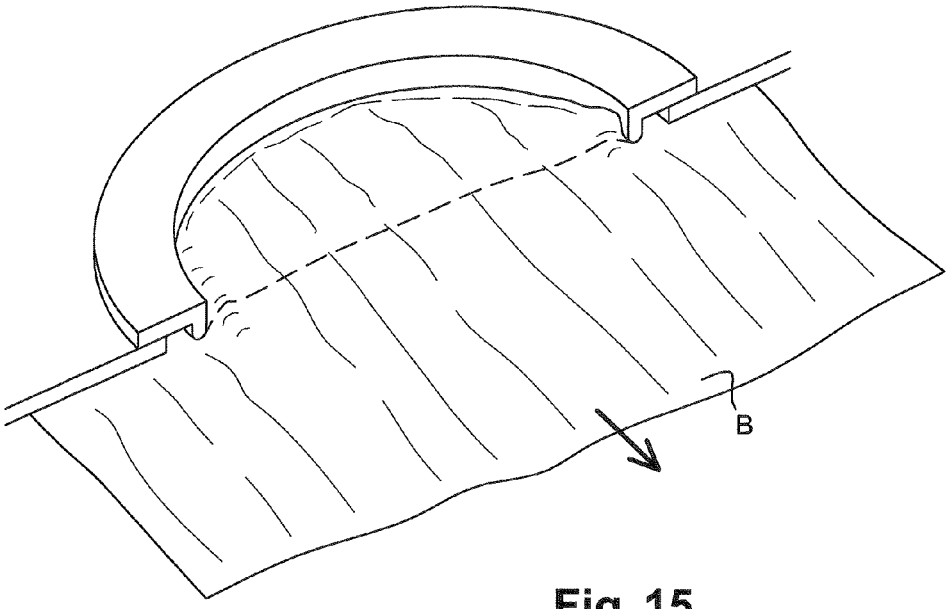
Fig. 15

APPARATUS FOR DISPENSING PRECUT MATERIALS WOUND INTO A COIL OR FOLDED INTO A "Z"

BACKGROUND

1. Technical Field

The invention relates to the technical field of apparatus comprising pre-cut materials wound into a coil or folded into a "Z", especially for wiping materials like paper towels, toilet paper, kitchen roll, paper, cellulose wadding, or non-woven material.

2. Description of the Related Art

For a proper understanding of the invention, it is necessary to reiterate the various research and development activities carried out by the Applicant which have helped find a new solution for the distribution of pre-cut materials.

The Applicant has developed a device for dispensing pre-cut wiping materials, the subject of French Patent 2 931 350. This device is of the type that comprises a casing forming a receptacle with a bottom plate, a lower horizontal wall and lateral walls with a hinged lid on an axis. This device further comprises an articulated shutter relative to the walls of the casing in the lower part thereof, according to this patent instruction. This component is clipped with respect to the said walls to enable it to be positioned in a vertical plane. In its upper part, the shutter preferably has a curvilinear shape, and in its lower part, a central cut that is substantially semi-circular to allow dispensing of the pre-cut wiping material. The lid also has on its underside a central cut similar to the aforementioned cut. The said central cuts on the shutter and the lid have the sole function of enabling the strip of material to be released after it is held and pulled out by the user.

The wiping material (M) in this implementation is provided in the form of a strip that is pre-cut and wound into a coil, or it can be in a pre-folded Z position.

According to the French patent cited above, the lower part of the apparatus at the place of release of the material has opposing stops on either side of the strip of material while ensuring the separation of a part of the strip with respect to the pre-cut line facing the strip. The pull force will ensure that at the end of the strip, between the front wall of the shutter and the side opposite the lid facing the lid, a part of the strip is separated with respect to the rest of the coil or the stack of material folded into a Z due to the said stops. According to this patent, it has been clarified that the said stops can be adjusted into position on either side of the outlet for release of the strip of material by appropriate sliding means.

The Applicant has observed that there is a wrinkling effect on the strip of material at the outlet due to the effect of shrinkage of the strip of material when it passes between the stops. In principle, this does not cause a problem as most users do not give importance to the presentation of the strip of material, which is then cut by forcibly folding the strip while operating the apparatus as a paper towel, kitchen roll, etc.

However, to address this issue, the Applicant has designed a new device that is the subject of the patent FR 2960760. Briefly, the apparatus comprises a casing with a hinged lid arranged on an axis, and a shutter hinged on the side walls of the casing. The strip of material which is pre-cut or pre-folded into a Z is likely to bypass the upper curvilinear part placed at the top end of the shutter. The strip of material (M) thus passes against the shutter and the inner side of the lid. In its lower part, the lid has a central cut. The shutter also has a central cut for the passage and release of the strip of material. The shutter and the lid have additional pairs of curvilinear rainbow-shaped forms that may partially fit together during the passage of the strip of material. More specifically, these parts are the ribs and grooves.

In the context of this patent FR 2960760 and to minimize any effect of wrinkling of the material during its passage between the complementary fitting elements, it is intended that the strip of material is fully wound between the shutter and the inner wall of the lid, without lateral deformation, and by projecting on either side the male-female complementary elements positioned according to the rib-grooves provided on the shutter and the lid, without any stops. There are several complementary elements that constitute grooves and ribs and are rainbow-shaped, according to substantially greater amplitude than 180°. These elements are arranged directly or with an additional means of reducing space between certain parts of the ribs and grooves to enable and facilitate the separation of a section of the strip of material, when pulled by the user. These elements form a constant section in terms of the height throughout their curvilinear configuration and the height is strictly the same for each pair of grooves or ribs. It is possible for the sets of ribs-grooves formed on the casing not to be concentric with the sets of ribs-grooves formed on the lid. However, the heights are exactly the same.

The purpose of this complementary means comprising protruding elements that form teeth is to narrow the space between the grooves and the ribs during the fitting. This space reduction leads to the formation of zones for retaining the strip of material that will facilitate the initial part of the tearing section. These indentations or teeth are arranged in the lower end of the concentric rainbow-shaped element, and favor the separability of the material if pulled forcibly.

This material passes between the complementary rib-groove elements. The objective behind this invention to prevent wrinkling of the strip of material is not fully achieved due to problems related to the thickness of the materials found on the market and offered by many manufacturers. Furthermore and as in the French patent FR 2 931 350, the central cuts formed on the shutter and the lid have the sole and exclusive purpose of allowing the strip of material to be released while it is held and pulled by the user.

The Applicant has also developed in the French patent application 1058449 an apparatus for dispensing wiping material, comprising a fastening casing that consists of a hinged lid for closing it; the casing has a removable fixed module. This module is itself arranged with a shutter placed opposite the inner side of the lid; the strip of material passes between the shutter and the internal wall of the lid. The central cuts formed on the lid and the shutter still have the same functions as indicated previously.

The Applicant has also developed an improved apparatus for the passage of the strip of material between the shutter and the inner wall of the lid. This solution is described and illustrated in the French patent FR 1161439.

The casing forms a receptacle for the wiping material that is pre-cut or pre-folded. The lid is hinged in relation to the casing. The shutter is mounted between the side flanges of the casing. In the plane above the said shutter, a reversing rod is provided. It is mounted in free rotation between the flanges of said casing, in order to allow the return of the pulled strip of material between the shutter and the inner side of the lid. The inner side of the lid and the visible side opposite the shutter are arranged with pairs of grooves and ribs. The solution, according to French patent FR 1161439, aims to form and place a crescent-shaped support area between the pair of ribs and grooves of a smaller diameter and the opening formed on the shutter and the lid, in order to facilitate the passage of the material.

According to this patent, the lower end portions of the pairs of ribs-grooves are arranged with protruding and transverse recessed elements respectively on the ribs of the shutter and the lid and then into the grooves of the shutter and the lid. Specifically, the shutter and the lid are arranged at the end portion of the pairs of ribs and grooves with a flattened transversal flap of minimum thickness which allows the positioning and the securing of a flexible strip made of a different and deformable material on the receiving flap. The strips have a configuration complementary to the ribs and grooves to ensure continuity with the latter. The height of the ribs is always constant. The central cuts formed on the lid and the shutter still have the same functions as indicated previously.

In another embodiment described in French patent FR 1161439, the shutter and the lid have a number of pairs of complementary elements opposing it. They are rainbow-shaped and capable of fitting into each other after the lid is closed. The said complementary elements are corrugated and have, alternately, successive curved and recessed shapes, thus avoiding any roughness or a cutting area with one or more sharp edges. Moreover, in combination, one of the corrugated elements, either on the shutter or on the inner part of the lid, has in a transverse position and near its end a recessed cavity with a curvilinear or a semicircular profile. In addition, in combination, the said cavity is bordered by a corrugated end part having the same curvature as the waves formed either on the shutter or the inner portion of the lid. The said corrugated end part adjacent to the recessed cavity constitutes on its inner side a stop zone for the pulled strip of material. All the said corrugated parts have a regular shape. Furthermore, the central cuts formed on the lid and the shutter still have the same functions as indicated previously.

In practice, all the previously explained solutions of the Applicant demonstrate ongoing research to constantly improve the operating conditions of these devices dispensing pre-cut strips of materials. There are issues related to the highly substantial variations in the quality of such materials, in terms of their thicknesses, weights, wadding, and non-woven materials (these are cited as non-exhaustive examples). The multiplicity of filings of patents by the Applicant, who has more than 40 years of experience in this type of device (first filing in 1968), shows the difficulty in solving all these problems.

BRIEF SUMMARY

It is thus in this constant search for improvement that the Applicant has designed an apparatus for dispensing pre-cut materials which is totally different from the above-mentioned prior art for the distribution of the strip of material pulled by the user. This is regardless of the type of material dispensed: paper, cellulose wadding, non-woven material, including very thin and brittle strips of material. This new design of the dispensing device allows it to have a compact, simplified and economical configuration, with a perfect presentation of the strip of material to be released from the said device and the appropriate section of the material to be pulled out.

According to a first characteristic, the apparatus for dispensing pre-cut material wound into a coil or folded into a "Z" consists of a casing forming a receptacle with a bottom plate, a lower horizontal wall, and vertical walls with a lid that is hinged at the base of the casing and raised vertically up to its closure. The apparatus also comprises a shutter attached to the side walls of the casing positioned vertically. The said flap has in its upper portion a curvilinear configuration for the passage and guidance of the pre-cut strip of material. The said strip of material passes between the shutter and the lid. The said shutter and said lid each have an identical central cut to allow the release of the pre-cut strip of material and its gripping. The said dispensing device is remarkable in that around the peripheral edge of said cut, the shutter has an element with a curvilinear configuration over the entire circumference of the peripheral edge of the said central cut formed on the shutter perpendicular to the shutter plane. It is also peculiar in that the said element has a progressive height differentiated from its central part that corresponds to the upper part of the central cut up to its ends, thus forming a ramp. The ends of said element provide penetration into the strip of material in the pre-cut line thereof to ensure the full tearing and separation along transverse lines of a given section of material.

These and other features will become apparent from the following description.

BRIEF DESCRIPTION OF THE SEVERAL VIEWS OF THE DRAWINGS

To determine the object of the invention illustrated in a non-exhaustive manner in the drawings, where:

FIG. 1 is a schematic perspective view of a device for dispensing pre-cut material arranged in a closed position, according to a first implementation of the invention, FIG. 2 is a schematic perspective view of a device for dispensing pre-cut material arranged in an open position, according to the invention in the said first implementation, FIG. 3 is a partial perspective view of the element provided on the shutter portion according to the invention in the first implementation, FIG. 4 is a partial schematic side view that illustrates the positioning of the shutter in relation to the said element before the connection and closing of the lid, FIG. 5 is a schematic partial view complementary to FIG. 4 that illustrates the positioning of the shutter in relation to the said element after the connection and closing of the lid, FIG. 6 is an alternative view of a second implementation of the invention; the shutter and the lid are arranged in a complementary manner, with the first element being on the shutter and a counter-element on the lid, FIG. 7 is a partial schematic view complementary to FIG. 6 illustrating the first element on the shutter and the counter-element on the lid, FIGS. 12 to 16 are schematic views for the purpose of explaining how to separate a section of the strip of material in one of the implementations of the invention. The section of the strip of material is separated under conditions similar to those shown in the said figures, FIG. 12 shows schematically the element on the shutter and the counter-element on the lid before the presentation of the strip of material, FIG. 13 shows the strip of material as it appears prior to being pulled by the operator, with a view to pulling the strip to obtain the required section, FIG. 14 illustrates the start of traction of the strip of material, and the appearance of the pre-cut line, FIG. 15 illustrates the entry of the pre-cut line at the ends of the element positioned on the shutter and aperture formation, in order to achieve the partial separation of two successive sections, FIG. 16 is a view illustrating the final separation of the section of the pulled strip of material.

DETAILED DESCRIPTION

Figure 8:
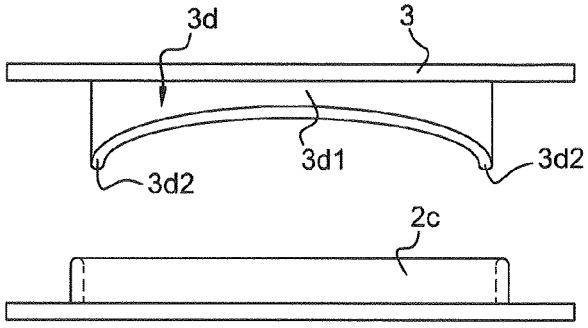
FIGS. 8 and 9 are schematic views that illustrates the positioning of the first element on the shutter and the counter-element on the lid before and after closing the lid.
Figure 9:
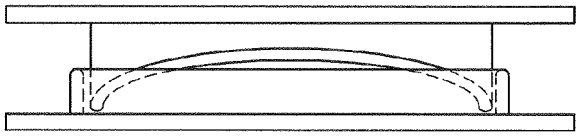
Figure 10:
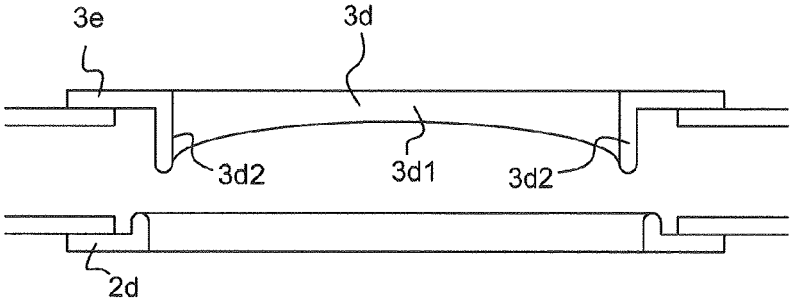
FIGS. 10 to 11 are views complementary to FIGS. 8 and 9 where the element and the counter-element are attached and fixed on the shutter and the lid.
Figure 11:
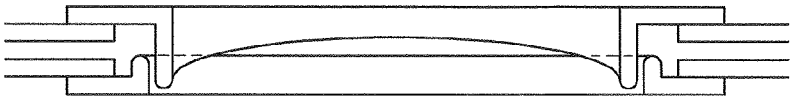
Figure 16:
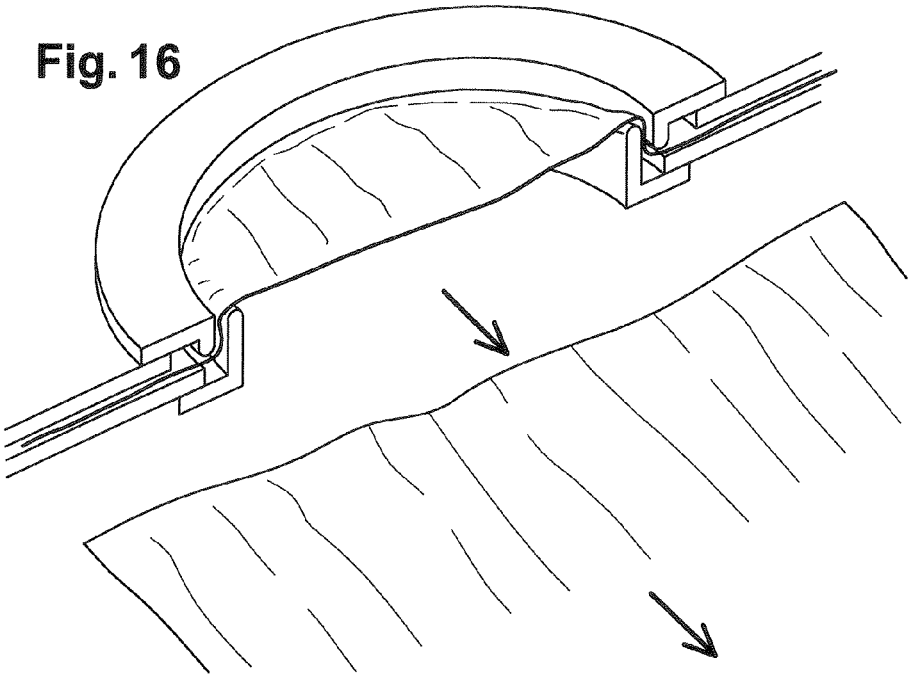

In order to make the object of the invention more concrete, it is described in a non-exhaustive manner in the drawings.

The device for dispensing pre-cut materials wound into a coil or folded into a "Z" is referenced in its entirety by (A).

The pre-cut materials are, for example, wiping materials, paper or cellulose wadding. They may also be non-woven materials.

The apparatus consists of a casing (1) forming a receptacle with a bottom plate (1*a*), a horizontal bottom wall (1*b*), side walls (1*c*) with a lid (2) hinged in relation to the casing by a lug assembly or axis (2*a*) with a receiving hole. The strip of material is referenced by (B). The lid is vertically raised for its closure. It further comprises a shutter (3) hinged with the two side walls of the casing. It is secured in a removable manner by clipping it to the axes or positioning lugs in the receiving openings formed on the side walls of the casing. The shutter is positioned vertically in its upper and transverse portion. The said flap is fitted with an element (3*a*) that constitutes a reversing rod of the material with a curvilinear configuration, in order to achieve the passage and guidance of the strip of material from the receptacle of the casing. Alternatively, as shown in FIG. 2, the shutter (3) is not arranged directly with the reversing rod; instead, an independent reversing rod (4) is attached and fixed on top of said shutter with the curvilinear element described above.

In its lower part, the shutter has a central cut (3*b*) to allow the release of the strip of material. The lid (2) has on its underside a central cut (2*b*) identical and opposite to the cut (3*b*) of the said shutter.

According to the invention, at least the shutter (3) has around its peripheral edge (3*c*) an element (3*d*) that has a curvilinear configuration over the entire circumference of the peripheral edge of the cut (3*b*). The said element (3*d*) is positioned in a plane perpendicular to the shutter plane which has been placed as an external overlap thereof to be opposite to the closing lid. This element (3*d*) has a progressive height differentiated from its central portion (3*d*1). The lowest height corresponds to the upper part of the cut (3*b*) which extends up to its ends (3*d*2) with a height (h2) greater than said height (h1). The said element (3*d*) thus produced, therefore, has a ramped configuration whose function is provided below.

The ends (3*d*2) of the ramp are protruding and are positioned opposite the pre-cut line of the strip of material, in order to allow transverse tearing for obtaining a given length of material. As shown in FIG. 5, the said ends (3*d*2) go substantially beyond the outer apparent side of the lid. For information, the height (h1) is a few millimeters, about three to five millimeters, and the height (h2) up to the ends (3*d*2) is in the order of six to fifteen millimeters. The edge of the said ends (3*d*2) is pointed, or preferably tapered and rounded, in order to avoid any injury.

On the edge of the element, it is possible to place, mold or secure an elastomer packing overlapping the edge, in order to ensure a braking function for the material and allow the stretching of pre-cut points on the pre-cut line.

In other words, if we refer to the drawings, after closing the lid on the casing, the strip of material is placed between the shutter and the lid by sliding on the element (3*d*) constituting the ramp and with the central part (low height) (h1). It then moves, due to the traction caused by the user, along the element (3*d*) until it reaches the ends (3*d*2) and then up to the height (h2). At this time, the pre-cut line of the strip of material reaches the said ends (3*d*2) of the element (3*d*), which penetrate into the material by then allowing full transverse tearing of the strip of material in a given format.

In practice, this has a dual effect. It results in pressure on the strip of material which is on the peripheral rim of the central opening (3*b*) and the element (3*d*). This, in combination with the slope of the ramp and the release of the ends (3*d*) of the element in the material, allows the separation of a section of the strip of material.

The element (3*d*) associated with the central cut (3*b*) of the shutter provides a new function thereto, i.e., a cutting function. In a way, the central cut (3*b*) thus designed with the element (3*d*) creates a "distributive opening" of the strip of material. It is therefore an entirely new design that is different from the prior art indicated in the preamble to this application.

In addition, the lid (2) can be placed in combination with the shutter (3) mentioned above, depending on different layouts.

In the first embodiment, the lid (2) has a smooth and flat inner surface without the addition of complementary means around its central cut (2*b*) which has the same configuration and shape as the cut (3*b*) of the shutter (3). This is illustrated in FIG. 2. According to tests conducted by the Applicant, the strip of pre-cut material, in particular wiping material, is completely separated by the action of the element (3*d*) and its end portions (3*d*2).

In a second embodiment shown in FIGS. 6 and 7 in particular, the lid (2) is arranged with a counter-element (2*c*) positioned around the central opening (2*b*) which is directly molded or secured on the inner side of the lid. This counter-element (2*c*) may have a regular and constant height (h3) throughout its length.

When closing the lid (2) on the casing, the said counter-element (2*c*) surrounds the element (3*d*) of said shutter (3) while leaving a small passage for the strip of material.

Figure 17:
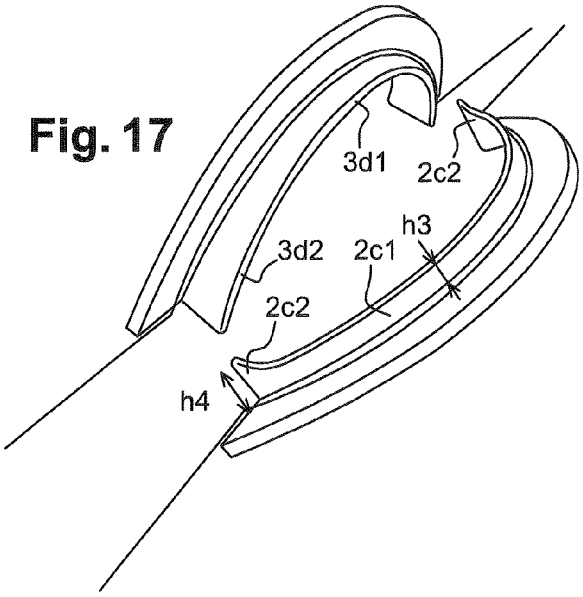
FIG. 17 is an alternative view of the second implementation of the invention.
Figure 18:
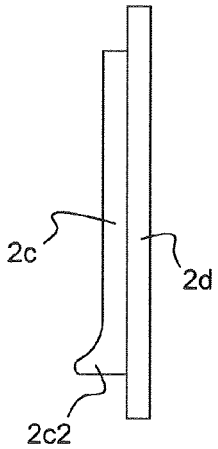
FIG. 18 is a view illustrating the profile of the counter-element.

In an alternative embodiment, as per FIGS. 17 and 18, the counter-element (2*c*) can be designed in a manner similar to the element (3*d*) of the shutter. It has a progressive height from its central part (2*c*1) to its ends (2*c*2) respectively with the heights (h3) and (h4). The height (h4) is greater than height (h3). Thus, we obtain additional end projections that are particularly useful for dispensing thick wiping materials and non-woven materials which are placed opposite the ends (3*d*2) of the element (3*d*) after closing the lid.

As indicated above, the element (3*d*) on the shutter, and the counter-element (2*c*) on the lid, are molded directly with them. We thus obtain a device with only three or four components: the casing, the shutter, the lid and the reversing rod, if it is independent of the shutter, without any additional parts and components.

As shown as an example in FIGS. 10-17, the element (3*d*) on the shutter (3) and the counter-element (2*c*) may also be fixed. In this case, they each have a heel (3*e*) (2*d*) of curvilinear configuration that is secured in any suitable manner. In this case, the element and the counter-element can be of the same material as the shutter and the lid or of a different material. In this implementation, we thus obtain a set of elements (3*d*) and counter-elements (2*c*) that help to adapt the dispensing device to the type of pre-cut material to be dispensed.

The invention provides a new concept of a device for dispensing pre-cut material wound into a coil or folded into a "Z". It provides a new function to the one or two opening(s) provided on the shutter and the lid, i.e., the function of cutting the material.

In addition, this new arrangement of the device allows the opening formed on the shutter and in the different variants in combination with the opening formed on the lid to provide four functions:

Better presentation of the material that is not wrinkled at the outlet of the device and is presented in a straight line and without overlapping the bottom part of the device.

Easy gripping of the strip of material,

Diametral spacing with pressure applied to the strip around the central opening combined with the ramp effect and maximum height of the element at the release of the material. This allows the stretching of pre-cut points of the pre-cut line, Separation of sections.

Any distribution and cutting of the strip of material takes place in the space of the opening (3*b*) of the shutter. It is thus possible to have a compact and economical device. No part is in motion, and there are no maintenance problems.

The apparatus thus developed enables the dispensing of all flexible pre-cut materials, wiping paper materials and nonwoven materials.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An apparatus for dispensing pre-cut material wound into a coil or folded into a "Z" to form a pre-cut strip of material, comprising:

a casing including a bottom plate, a lower horizontal wall, and side walls to define a receptacle;

a lid that is hingedly coupled to a base of the casing, the lid being moveable from an open position to a closed position and having a first passage; and a shutter attached to the side walls of the casing, the shutter including:

a second passage, the second passage being curvilinear and configured to allow the pre-cut strip of material to pass between the said shutter and said lid; and an arcuate element extending along a length of a curvilinear peripheral edge of the second passage and extending perpendicularly outward relative to a front outer surface of the shutter, the arcuate element having an arcuate outer surface having a depth measured perpendicularly to the front outer surface of the shutter that is wider at first and second distal ends of the arcuate element than at a central location of the arcuate element, the depth progressively changing from the first and second distal ends to the central location of the arcuate element to facilitate transverse tearing and separation of a given section of material.

2. The apparatus according to claim 1, wherein the lid has a smooth and flat inner surface without the addition of complementary means around the first passage.

3. The apparatus according to claim 1, wherein the lid is arranged with a counter-element positioned around the first passage.

4. The apparatus according to claim 3, wherein the counter-element has a constant height throughout its length.

5. The apparatus according to claim 3, wherein the counter-element has a height at a central portion thereof, the height progressively changing from the central portion to ends of the counter-element.

6. The apparatus according to claim 3, wherein the arcuate element on the shutter, and the counter-element on the lid, are molded directly with the shutter and the lid.

7. The apparatus according to claim 3, wherein the arcuate element on the shutter, and the counter-element on the lid, are secured and have a heel and a curvilinear configuration that adapts around the first and second passages formed respectively on the lid and the shutter.

8. The apparatus according to claim 1, wherein an edge of the arcuate element is configured to secure an elastomer packing overlapping the said edge for ensuring a braking function for the material and allowing the stretching of pre-cut points on the pre-cut line placed on the material.

9. The apparatus of claim 1 wherein the first and second distal ends of the arcuate element extend beyond an outer edge of the lid.

* * * * *